United States Patent [19]

Dorsey

[11] 3,935,789

[45] Feb. 3, 1976

[54] REVERSING VALVE

[75] Inventor: Alva Nelson Dorsey, Sykesville, Md.

[73] Assignee: The Black and Decker Manufacturing Company, Towson, Md.

[22] Filed: July 19, 1974

[21] Appl. No.: 489,994

[52] U.S. Cl. ..... 91/317; 91/325; 137/624.14

[51] Int. Cl.[2] ..... F01L 25/04; F01L 21/02

[58] Field of Search ..... 137/624.14; 91/317, 299

[56] References Cited

UNITED STATES PATENTS

| | | | |
|---|---|---|---|
| 1,771,181 | 7/1930 | Lear | 91/317 |
| 1,852,591 | 4/1932 | Smith, Sr. et al. | 91/317 |
| 1,924,812 | 8/1933 | Shaff | 91/317 |

FOREIGN PATENTS OR APPLICATIONS

| | | | |
|---|---|---|---|
| 686,729 | 4/1930 | France | 91/317 |

*Primary Examiner*—Paul E. Maslousky
*Attorney, Agent, or Firm*—William Kovensky; Joseph R. Slotnik; Leonard Bloom

[57] ABSTRACT

An improved air reversing valve, as for use with a pneumatic scaler, chisel or the like, comprising throttling means between the two sides of the valve disc whereby the tool's performance characteristics are generally improved. Additionally, the valve is made multi-element whereby its manufacture is simplified, as by powdered metal casting internal passageways in facing surfaces of adjacent parts, rather than cross drilling or the like.

17 Claims, 7 Drawing Figures

FIG. 1
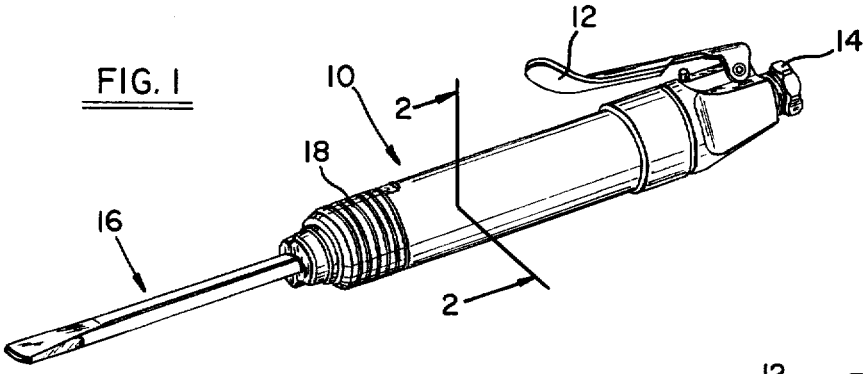
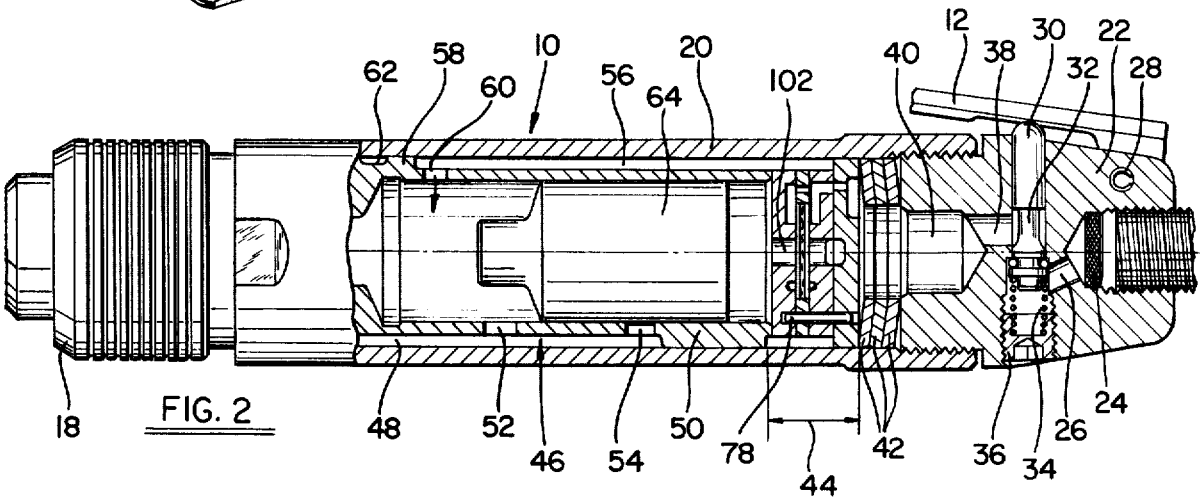
FIG. 2
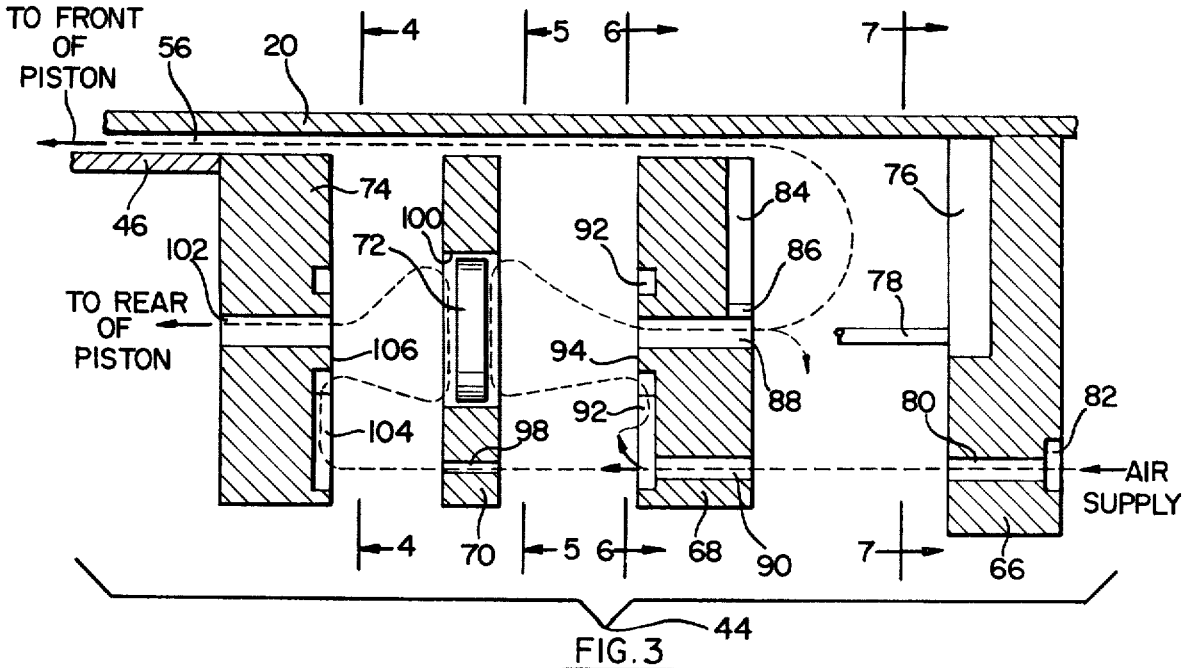
FIG. 3

REVERSING VALVE

This invention relates to an improved reversing valve. The invention valve is particularly useful in the field of air driven tools, and more particularly to such tools wherein the work contacting bit or other working implement reciprocates. Still more particularly, the invention pertains to an improved air reversing valve for use in tools such as scalers or chisels.

The invention valve is of the known flutter disc or vibrating wafer type. In this kind of valve, generally, the valving or reversing of the air is accomplished by an impermeable disc-like member which vibrates or rapidly reciprocates between two ports to thereby alternately open and close the two ports. These two ports are connected to opposite ends of the element which is to be reversed, usually a piston. Such valves, while well developed, have a number of problems which are overcome by the invention. Additionally, the invention provides a number of new advantages over the present state of this valve art.

Prior flutter valves suffer from the disadvantages that they require very close manufacturing tolerances which results in concomitant disadvantages of high cost, and increased field service. Another disadvantage is that these valves seldom have much flexibility. That is, once the valve is assembled it will operate at a certain speed, and will respond, more or less depending upon the nature of the particular valve, to changes in the air supply. However, the valve per se does not lend itself to structural changes which will change its capacity and/or performance characteristics. Still another related disadvantage is that such valves are frequently made in one piece, or sometimes two pieces, which necessitates much cross-drilling and complicated manufacturing processes, which, again, multiples their cost of production and aggravates the related problems having to do with replacement parts and the like. Another problem with such prior devices is that metals are frequently used as the wafer or vibrating element. The disadvantages of a metallic compared to a non-metallic valving element include greater susceptibility to wear, more expensive, heavier, and relatively inflexible as compared to the valve materials usable in the present invention.

The present invention overcomes all of these prior disadvantages, and additionally provides new advantage not heretofore obtainable. The valve of the invention is made up of five separate parts, all but one of which are relatively insensitive to and not "fussy" about dimensions, tolerances, and the like, and can be assembled and used directly as produced by the molding process. The one part, the valve guide and throttle plate, is of a washer shape, and thus lends itself to being fabricated even as to its sensitive areas in a simple straightforward manner. Three of the other four parts have recesses and grooves of various kinds and configurations which combine together to make the passageways through the valve, and these recesses and grooves are all highly not sensitive as to their depths and configurations within the parts of the invention valve. The result of the multi-part structure is that the valve of the invention lends itself to manufacture by the extremely economical powdered metal technology. In this manner, the previous manufacturing cost and material weight cost disadvantages are overcome.

At the same time, a valve is produced which lends itself to partial rehabilitation, rebuilding or changing as necessary. That is, if the valve should be damaged due to negligence by the user, only the one or two parts of the valve so damaged need be replaced, thus achieving new advantages in maintenance and servicing of tools embodying the invention valve.

The wafer guide and throttle plate of the invention provides great new advantages in flutter disc type valves. This member, fabricated by powdered metal technology and later finished by conventional means such as surface grinding, in large measure provides the invention valve its flexibility. That is, by simply changing the dimensions of the throttle openings, the speed and performance of the valve, as well as its air consumption, are easily changed, and performance and versatility are greatly improved over prior valves.

This cost advantage is particularly dramatic. It has been possible to replace a prior valve with a comparable valve embodying the invention and thereby reduce the cost by a factor of 4.

Another improvement of the invention is its use of non-metallic valve wafers, preferably reinforced phenolic. The lightweight wafer provides additional advantages, including high speed and lower inertia to improve the rapidity of the reversing action, low wear against the powdered metal parts with which it comes in contact because of its extremely light weight; low cost, ease of manufacture, and the ability to flex slightly during operation. In regard to wear, testing has shown that the invention valve is virtually free of wear. A prototype valve has been run for more than 1000 hours, and at the end of this period of time, corresponding to more than four life times of normal use of that tool, there was still no appreciable wear in the valve, although certain other parts of the tool had worn. Thus, the invention valve outlived the tool it was controlling. The wafer is the only moving part of the invention valve, which is in itself another advantage.

Another advantage is improved start-up. The lightweight wafer reacts to the initial air surge to begin fluttering, and thus start-up of the invention valve is completely trouble-free. During testing the tool commenced to work 100% of the trigger operations. In prior reversing valves for air tools, a certain percentage, ranging up to 60%, of starting failures is typically found, and then the operator must bump or shake the tool or repeatedly operate the trigger, to get it started.

In addition to the cost, wear and the other advantages above, the invention valve has generally better performance characteristics. That is, it uses less air, operates faster, and puts out more power as compared to prior valves. Air usage is important when many air tools are ganged in a single factory. By having each tool use less air, the factory can operate with a less expensive, smaller compressor than would be needed otherwise. In regard to speed, prototype valves used in needle scalers have been operated up to 5000 strokes per minute. Greater speeds are impractical because the piston in the tool heats up unacceptably due to the high velocity sliding friction. The valve of the invention, however, can go faster, the exact upper limit has not yet been determined. For the same overall size valve package, the invention valve has double tool power output with only a 25 to 30% increase in air consumption. In addition, the valve as presently used in commercial tools outperforms comparable tools with prior art valves while using 40 to 50% less air.

The above and other advantages of the invention will be pointed out or will become evident in the following detailed description and claims, and in the accompanying drawing also forming a part of this disclosure, in which:

FIG. 1 is a perspective view of a scaler embodying the valve of the invention;

FIG. 2 is a cross-sectional view taken generally on line 2—2 of FIG. 1;

FIG. 3 is an exploded cross-sectional view of the valve of the invention;

Figure 4:
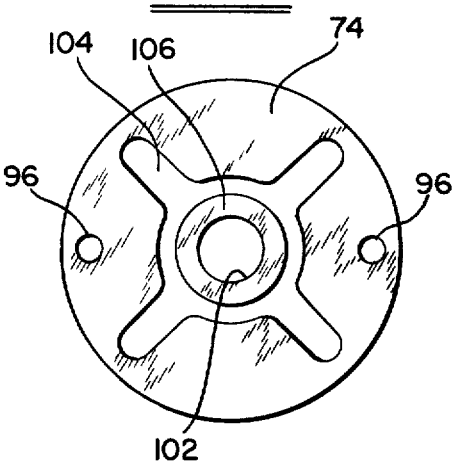

FIGS. 4, 5, 6 and 7 are elevational views of the valve elements taken on lines 4—4, 5—5, 6—6 and 7—7, respectively of FIG. 3.

Referring now in detail to the drawing, reference numeral 10 designates an air operated scaler. Tool 10 is more or less conventional with the exception of the invention valve described below. A trigger 12 controls the flow of air to the tool which is supplied by a conduit, not shown, connected to the fitting 14. A bit 16 is driven by the tool to remove scale or perform other useful work and a spring loaded collar 18 is provided on tool 10 for the purpose of changing the bit or mounting other working implements in place thereof, as is well known.

FIG. 2 is a generally longitudinal cross-sectional view, but taken, as indicated by the broken line 2—2 of FIG. 1, at an angle to the axis of the tool rather than straight through the tool. In this manner, FIG. 2 shows both sides of the valving in the single view. This is called a 90° or right angle view, and is in accordance with accepted industry drawing standards for air tools.

Tool 10 comprises a main cylinder 20 having an inlet housing 22 threadedly connected to its rear end. The air hose supply fitting 14 is screwed into the rear end of the inlet housing 22. A screen 24 is provided to protect the tool in the usual manner. A passageway 26 delivers the air to the trigger mechanism. The trigger operator member 12 is pivoted to the inlet housing 22 by means of a roll pin 28, or the like. The trigger mechanism 30 is conventional, and comprises an operating head which is depressed by the trigger operator 12 and a throttled or reduced neck portion 32 which controls the flow of air between the passageway 26 and the passageway 38 leading on to the valve of the invention. The conventional means to mount the trigger in the tool 10 includes a suitable O ring seal, a spring 34 and an anchor enclosure nut 36, as well as other parts not shown and/or not numbered. Passageway 38 feeds the throttled inlet air into an enlarged chamber 40. Chamber 40 serves the function of reducing the weight of the tool.

Within the main cylinder 20 forwardly of the inlet housing 22, the tool 10 comprises a plurality of relatively strong Belleville springs 42. As is known, the parts are heavily torqued together to compress the springs 42, to thereby hold all the parts in tension, to provide a tight seal between the elements of the valve, and to prevent the vibration to which the tool is subject in use from shaking the various threaded connections apart. The invention valve 44 is located forwardly of the springs 42 and is described and shown in greater detail below.

A cylinder liner and manifold member 46 is mounted forwardly of the valve 44 and is press fitted into the cylinder 20 as shown. The value of the air tool industry convention of 90° views is well illustrated by the liner and manifold 46, however, care must be taken in understanding the drawing or confusion is possible. The member 46 is basically a hollow cylinder. A pair of 180° opposed flats 48 are milled into the outside of the liner 46 and terminate at a pair of lands 50. These flats 48 define the exhaust manifolding for the tool and the wall of the liner is provided with openings 52 and 54 which communicate these flats 48 with the space inside the liner. Only one of these flats 48 appears at the bottom of FIG. 2, but there are in fact a pair of opposed flats each with an opening 52 and 54. The opening 52 exhausts the cylinder on the forward stroke of the piston, and the opening 54 serves as exhaust port on the rearward stroke. The flats 48 communicate with other passageways, not shown, to direct the exhaust air axially out of the tool and along the working implement in order to blow chips from the work, in the conventional manner. On the two remaining sides of the cylinder offset by 90 degrees from the flats 48, the member 46 carries a second pair of 180° opposed flats 56 which extend from the rear forwardly and define a pair of lands 58. A pair of ports 60 are provided one in each of the flats 56 to provide pressurized air to drive the piston. The front lands 58 are formed with a groove 62 which communicates the two flats 48 with each other to equalize the exhaust side pressure. The inlet side pressure at the flats 56 is equalized by the valve 44 of the invention, as will appear below.

The liner is press fitted inside of the cylinder 20 by means of the two rear end lands 50 and the two front end lands 58, as well as by unmilled portions of the outside of the cylinder, between the flats 48 and 56.

The piston 64 is slidingly received inside the cylinder liner 46. This piston is a hardened and polished solid cylinder of steel, and is conventional.

While the invention was developed for and is specifically shown in use as a reversing valve for an air operated tool, its full scope of application is much broader. The invention can be used in any reversing sort of environment or wherever it is required to alternately provide a flow of pressurized fluid between two points of use or two "delivery means". Thus, the term delivery means as used in the specification and claims herein shall be understood to mean that part of any environment in which the invention may be used wherein the flow of pressurized fluid is alternately supplied first to one passageway, conduit or the like, and then, alternately, to a second such passageway, conduit, or the like, whether for reversing the motion of an element such as a piston, or for any other purpose. Referring to FIG. 3, the two delivery means in the illustrated embodiment would comprise, first, the passageway 102; and, second, the passageway 88 and the other passageways in the valve and in the tool after 88 to supply the pressurized air to the front of the piston. Similarly, the term "working implement" as used in the specification and claims herein shall be understood to include needle scalers, scalers, chisels, and the like devices which perform work by reciprocation and impact and which are adaptable for use with the invention valve.

Turning now to FIG. 3, the valve 44 of the invention is shown in greater detail. The valve 44 is a five part structure comprising a base plate 66, a middle plate 68, a wafer guide and throttle plate 70, a wafer or valving member 72 guided therein, and a cover plate 74. Turning to each of these parts in detail, and referring simultaneously to FIG. 3 and appropriate corresponding one of FIGS. 4 through 7, base plate 66 comprises a cross groove 76 running diametrically across its front face, and a pair of guide pins 78 secured in suitable openings. The pins 78 are on a diametrical line and offset by 90° from the cross groove 76 and serve as assembly guides for the alignment of remaining parts of the valve. A pair of passageways 80 of predetermined cross-sectional area extend through the base plate 66, and are located on a diametrical line approximately equally spaced between the two diameters defining the locations of the cross groove 76 and the guide pins 78. The rear face of the base plate 66 is provided with a pair of elongated recesses 82 of predetermined shape and configuration. These recesses serve to deliver the air from the supply with the aligned openings in the Belleville springs 42 and thence to the passageways 80 and on to the remaining parts of the valve and the tool.

FIG. 3 is an exploded view of the parts of the valve shown assembled together in FIG. 2. The dashed line running through FIG. 3 shows the path of air flow as controlled by the valve to the front and rear ends of the piston 64 in order to cause the piston to reciprocate in the cylinder 46. Additionally, FIG. 3 is taken on a broken view line, analogous to the line 2—2 on FIG. 1. The break and its location is apparent by a comparison, for example, between the right hand valve element and corresponding FIG. 7. Roughly, the cross-sectional line runs from the top of the valve down to the centerline and then off on approximately a 45° angle to the left.

The middle plate 68 comprises a cross groove 84 analogous in shape and location to the cross groove 76 of the base plate 66. The two cross grooves 84 and 76 together form a through passageway between these two plates and across the valve. This composite through passageway is part of one of the delivery means, i.e., it delivers the air under pressure under the control of the invention valve to the front of the piston. It is this structure of partially forming the groove in two valve members which is the key to the invention's improved cost of manufacture as compared to the prior art. That is, the passageway formed by the grooves 76 and 84, heretofore, would have to be cross drilled into a part. In the invention, by putting half of it in each of two facing members using powdered metal molding technology, the groove is formed automatically, thereby greatly reducing the cost over more conventional manufacturing techniques. Additionally, this split groove technique using powdered metal molding reduces the overall axial length of the valve, thus still further enhancing the invention's cost saving effect.

Plate 68 comprises a central through passageway 88, and the vicinity of the intersection of the passageway 88 and the cross groove 84 on the rear face of the plate 68 comprises a circular enlargment 86 surrounding the central passageway 88. This enlargement 86 serves to equalize the pressure delivered through the central axial passageway 88. Plate 68 is also formed with a pair of through passageways 90 which are similar in configuration to the passageways 80 of the base plate, and are aligned with these passageways 80 in assembled condition of the valve. The passageways 80 are slightly larger than the passageways 90 so that the flow is unrestricted to passageways 90 at which the first throttling of the air occurs. The front face of the middle plate 68 is formed with a recess 92 which is of generally four-armed configuration. The four arms are equally spaced on crossing diameters and the passageways 90 intersect on one diameter at the outer ends of two of these four arms. The inside of the recess 92 defines an annular valve land 94.

The enlargement 86, provided to aid in unformity of air flow out of the passageway 88, could just as well have been provided in a corresponding position in the base plate 66 as the function would have been performed just as well with this enlargement on either side. However, with an eye towards the use of powdered metal molding technology, it is preferred to put this enlargement in the middle plate 68 opposite the land 94 because it makes for a more uniform thickness of the powdered metal part cross section. That is, the enlargement 86 counterbalances the extension on which is located the valve land 94, and the center section around the passageway 88 is thus relatively uniform over the thickness of the part.

Figure 5:
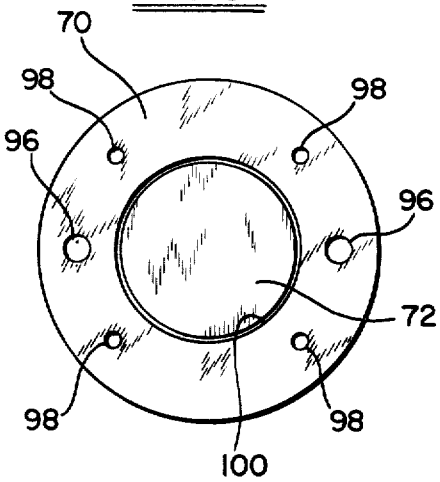
Figure 6:
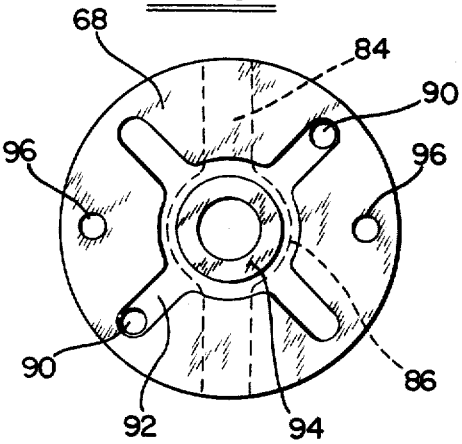
Figure 7:
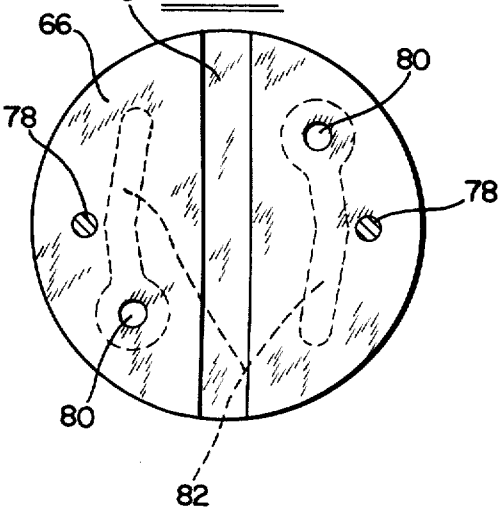

As shown in FIGS. 4, 5 and 6, the plates 68, 70 and 74 are each formed with a pair of guide openings 96 which snugly receive the guide pins 78 to hold these three parts in predetermined aligned relationship on the base plate with the various air passages in the relationship shown in FIG. 3. The guide openings 96 in the cover plate 74 are preferably blind openings in order to prevent any minor leakage which might occur between the interfaces in the valve from leaking into other surfaces. That is, if an air leak should occur and if it should migrate to an alignment pin hole, the leak will simply dead end at these blind openings.

Another advantage of the multi-part structure of the invention valve, as is shown best in FIG. 3, is that it is "idiot proof" in assembly. That is, in the event the parts are assembled wrong, as by being mounted on the base plate in the wrong order, or one or more parts being turned upside down, then the valve will not work at all. This failure to operate will immediately indicate that the valve must be reassembled properly. The "no operation" condition is preferred to a situation in which the valve might work to a limited extent or work improperly. "Not working at all" means the piston might perhaps make one stroke, and thereafter the tool might or might not "hiss air", but it will not run.

The wafer guide and throttle plate 70 is perhaps the most critical part of the valve 44 to manufacture. It comprises four throttle openings 98 of a predetermined diameter to produce a total cross-sectional area and predetermined amount smaller than the total cross-sectional area of the passageways 90. Plate 70 also comprises a central opening 100 of a diameter a predetermined amount larger than the outside diameter of the wafer 72. The parallelism of the two circular faces of the plate 70 have been found to be important in providing a tight air seal, and to define a uniform distance, edge to edge, for the wafer to travel. Therefore, this part is subjected to additional finishing operations after it is produced by the powdered metal process. The diameter of the opening 100 is not critical; it can be used as produced by the molding process, and no special surface finish inside is required. The thickness of the plate 70, aside from its parallelism, can vary a few thousandths of an inch with no adverse effect on performance. In prototype, it was found that, in view of the above, the part 70 can be a simple metal stamping or metal blank. The ratio of the diameters of the throttle openings 98 and 90 play a large role in defining the operating characteristics of the valve, discussed below.

The valve or wafer member 72 is preferably made of a nonferrous material. In the successfully constructed embodiment of the invention, this part was made of a canvas or fabric based phenolic resin impregnated laminate. This material, and other similar nonferrous materials, yield the advantages of lowering the cost of the part, producing a near wear-free part, and producing a lightweight valving member which responds quickly to changes in air pressure. Heretofore, ferrous members have been used generally, and they are relatively more expensive, and in this environment can stick or fail to operate due to oxidation, rust, and the like deterioration. Of course, upon the valve sticking, the tool can no longer be used, and must be taken apart and cleaned or the part replaced.

The cover plate 74 is formed with a central through opening 102 which delivers the air from the invention valve directly to the rear of the piston. The inside face of the plate 74 is formed with a recess 104 defining a land 106. The elements 104 and 106 of the plate 74 are identical to the corresonding parts 92 and 94 of the middle plate 68. Thus, in molding these two members in powdered metal, great savings in manufacture are achieved in that the same die can be used for one half of both parts. The opposite sides of these two parts are different; primarily, the cover plate is plain, and the middle plate contains the cross groove 84. Here again, it can be seen how the invention multi-part structure produces great advantages over prior art devices having internally drilled cross grooves and the like in a one or two part valve.

Another corollary advantage is the pair of elongated recesses 82 in the back surface of the base plate 66. The outer ends of these recesses 82, which are not used in the embodiment of the invention shown in the drawings, are provided for purposes of future expansion and versatility. That is, in the future, it might be desired to use the invention valve in a larger tool demanding a greater air flow. In such case, another pair of openings, analogous to the passageways 80, could be provided at the opposite ends of the elongated recesses 82, thereby effectively doubling the air supply through the valve. Of course, in such case, suitable changes would be made with regard to the throttling holes 98 in the plate 70 and in holes 90 in plate 68, depending upon the particular environment of such a future valve.

The delivery means between the valve wafer 72 and the front and rear of the piston include the axial passageways 88 and 102. This axial relationship yields important advantages for the present invention. As is known, the return of the piston after a stroke in one direction trips the valve wafer by back pressure to the opposite position in preparation for the next stroke in the opposite direction. The axial relationship of the passageways 88 and 102 therefore ensures that the valve disc 72 will not tip or cock as it reciprocates, because it is subjected to an axial force at its center. This results in a very smooth trouble-free operation as compared to prior art devices wherein this back pressure from the point being serviced impinges upon the valve disc in an annular ring thus increasing the possibility of the valve member cocking during its resetting motion.

As shown in FIGS. 3, 4 and 6, the two distribution recesses or pressurized regions 92 and 104 are of multi-lobed, four-armed, cloverleaf, or star-like configuration. This type of shape helps the invention achieve its advantages of smooth operation by providing an equalized pressurized region around the valve member 72. Another point in this regard, see FIGS. 4, 5, and 6, is that two relatively large passageways 90 are provided to feed the pressurized region 92, but that four smaller throttling openings 98 extend from this pressurized region 92 to the other side of the valve and to pressurized region 104. Thus, the smoothness of operation is maintained while at the same time the throttling effect and its advantages are maintained.

Yet another advantage of the multi-lobed shape is that the material between the lobes is positioned to support the edges of the valve disc 72 as it reciprocates between the two valve lands 94 and 106. In this manner, again towards the goal of smooth operation, the valve disc is saved against hitting solely on the relatively small annular valve surfaces, which, in testing of the invention, was found to score the surfaces of the valve disc. With the addition of these supports about the circumference of the disc, there was found to be virtually no wear on the disc. A valve was run for more than 1,000 hours, and no wear could be seen on the wafer, and the wafer is the only moving part in the valve. All the other valve parts serve only to define air flow passageways. The valve continued to work properly while other parts of the tool and test apparatus wore out and failed and were replaced.

During the invention's development, various experiments were tried in regard to the criticality of the throttle openings 98 and 90 with respect to each other. It was determined that it is the total cross-sectional area ratio which is critical. That is, as shown, there are only two delivery passages 90, and there are four throttle openings 98. On testing, other numbers of holes were tried, and it was found that the parameter of importance is the ratio of the total cross-sectional areas rather than number of holes.

During this extensive testing it was determined that the throttle openings 98 and 90 provide great versatility to the invention valve in that they permit the optimization of any particular parameter about the tool in which the valve is incorporated. For example, in working with air scaling hammers, the common parameters to consider are air consumption in CFM, blows per minute (BPM) or speed, and penetration rate or power as measured by any consistent method. It is desired that the air consumption be relatively low while the speed be relatively high and the penetration or power be relatively fast and strong. In addition to simply varying the total cross-sectional area of the plurality of openings 98, the size of the openings 90 in the middle plate is also an adjustable parameter. This testing attempted to quantify many different parameters. It was found that, with a starting point ratio of about a half, then increasing the size of openings 90, caused speed to increase and penetration to increase.

Ratio values are defined as the total cross-sectional area of all holes 98 to the total cross-sectional area of all holes 90. The number of holes was found not to have any substantial effect on performance, two and four hole systems were tested, and only total cross-sectional area changed performance characteristics. In effect, this ratio defines the valve air supply bias.

It was found that during the testing of all prototypes for this invention the ratio value determined the operating characteristics of a tool. For instance, in the case of a small air scaling tool, a ratio of 0.40 would result in a lower CFM, higher BPM and more blow energy than a ratio of 0.50. At a ratio of 0.60 air consumption was about maximum but speed and blow energy was reduced. This invention has been successfully tried in a much larger tool, an air chipping hammer, on a prototype basis with the invention replacing an older valve of a steel, semi-circular disc design.

Thus, for this small air scaling hammer it was found that a ratio of about 0.40 resulted in lower CFM, increased speed and higher output, than a ratio of 0.50. As the ratio was lowered below 0.40 the tool ran slightly faster, but output started to drop. At the extremes of ratio, approximately 0.30 or below or 0.75 or above, the scaler ran roughly missing blows with little output. These test results were for one particular tool using the invention valve.

For tools with longer barrels and relatively short pistons, a higher ratio than normal for scalers would probably be more useful. The invention can be readily changed to accomplish this, conversely, a short stroke, short piston tool would use a lower ratio range to compensate for reduced air passage lengths in the cylinder and liner construction.

Thus, the invention valve can be readily tailored to changes in tool barrel and piston length (air passage volume and length), air flow, speed and tool output as required for any particular work it might be required to do.

It was found during this testing that if the throttling effect was removed entirely, that is, if the total cross sectional areas of the openings 98 and 90 were made equal, then the tools slowed down to an unacceptably slow level and power or penetration went down unacceptably low, although air consumption was not greatly affected which is not surprising in that air consumption is a function almost entirely of the cross-sectional area of the openings 90.

OPERATION

The air from the supply is throttled and controlled by operation of the trigger 12 and its throttle portion 32 in the conventional manner. The air then passes to the invention valve 44 first via the recesses 82 and thence through the aligned openings 80 and 90. This air supply is constantly present at and passes through the throttle openings 98 and on to the recess 104 in the cover plate. At the same time the recess 92 in the middle plate 68 is constantly pressurized. Thus, upon exiting from the passageway 90 in the middle plate 68, the air supply is split, pressurizing both the throttle openings 98 and the recess 92. The initial surge of air immediately starts the valve wafer 72 vibrating between its two valve lands 94 and 106. Thus, one or the other only of these two pressurized regions, i.e., recess 92 or recess 104, is allowed to communicate with its corresponding delivery passageway 88 or 102 respectively. When the wafer is to the left, in FIG. 3, then passageway 88 is pressurized and the air flows as shown to the front of the piston. When the wafer is to the right, the opposite condition occurs, and the rear of the piston is pressurized. The piston return from either position creates a back pressure which moves the valve wafer to reset the valve for the next piston stroke. In this manner the piston is forced to reciprocate in its cylinder. The various openings in the cylinder, 52, 54 and 60, operate in their conventional manner.

The speed of reciprocation of the wafer 72 is proportional to the ratio of the total cross-sectional areas of the holes 90 and 98 in any particular tool.

While the invention has been described in detail above, it is to be understood that this detailed description is by way of example only, and the protection granted is to be limited only within the spirit of the invention and the scope of the following claims.

I claim:

1. An air tool including a housing, an air motor in said housing including a cylinder having a piston reciprocable therein, an air inlet in said housing connectable to an air supply a working implement supported by said housing, an air control valve interposed between said air inlet and said cylinder to alternately provide pressurized air to opposite ends of said piston to cause said piston to reciprocate and to deliver blows to said working implement; said valve comprising a tandem arrangement of a base member, a middle member, a valve guiding member, and a cover member; a valve member reciprocable in an opening in said valve guide member, means to flow air from said air inlet to the opposite sides of said valve member, said flow means including port means in said middle member and said valve guide member communicating with first and second passage means, respectively, at opposite sides of said valve member, the cross-sectional area of said first and second passage means being greater than the cross-sectional area of said middle member port means and said valve guide member port means, respectively, whereby the flow of air from each said port means to its respective passage means is substantially unrestricted, the cross-sectional area of said valve guiding port means being in the range of from about 30% to about 75% of the cross-sectional area of said valve guide member port means, whereby to throttle the air as it passes through said valve guide member port means, whereby the air pressure at said second passage means is lower than the air pressure at said first passage means, first delivery means extending through said cover member to deliver the air from said second passage means under the control of said valve member to one end of said piston to power said piston through its working stroke, and second delivery means extending through portions of at least said middle member and said base member to deliver air from said first passage means under the control of said valve member to the opposite end of said piston to return said piston.

2. The combination of claim 1, wherein all of said members are of generally cylindrical configuration, first and second recessed regions formed in said middle member and said cover members respectively and facing the opposite sides of said valve member, said first and second regions being of generally multi-lobed configuration with the lobes extending radially outwardly, and said flow means in said base member comprising passageways formed in said base member and communicating with the outermost portions of at least one of said lobes.

3. The combination of claim 1, wherein said base member, said middle member, said valve guiding member, and said cover member are each made of powdered metal.

4. The combination of claim 1, wherein said second delivery means comprises a composite cross groove located between said base member and said middle member defined by facing grooves formed one in each of said base member and said middle member.

5. The combination of claim 1, wherein said cover member is formed with a recessed region in one face thereof, said region at least partially defining the outside of a valve seat facing one side of said valve member, said valve seat being of annular configuration and surrounding a central through opening extending through said cover member from said one face thereof to the opposite face thereof, and said central through opening comprising at least a part of said first delivery means.

6. The combination of claim 1, wherein said middle member is formed with a recessed region in one face thereof, said region at least partially defining the outside of a valve seat facing one side of said valve member, said valve seat being of annular configuration and surrounding a central through opening extending through said middle member from said one face thereof to the opposite face thereof, and said central through opening comprising at least a part of said second delivery means.

7. The combination of claim 1 said valve member including a circular disc, and first and second valve seats formed in said middle member and cover member, respectively, on the opposite sides of said valve disc, each of said valve seats comprising an annular land formed in one face of a respective one of said middle member and said cover member, said first and second passage means each including an annular portion surrounding a respective annular land and adjacent the periphery of said valve disc.

8. A pressurized fluid tool including a housing, a cylinder in said housing and having a piston reciprocable therein through a power and a return stroke, a valve for alternately interconnecting a supply of pressurized fluid to first and second delivery means in said housing communicating with opposite ends of said cylinder, said second delivery means communicating with the end of said cylinder to move said piston through its power stroke, and said first delivery means communicating with the end of said cylinder to move said piston through its return stroke, said valve comprising a base member including means to flow the pressurized fluid to other members in said valve and means at least partially defining said first delivery means, said valve further comprising a middle member having a defining means cooperative with said defining means of said base member to at least partially define said first delivery means, said middle member comprising a first region adapted to be pressurized from said fluid supply, said middle member comprising a valve seat interposed between said first region and said first delivery means, said valve further comprising a cover member, said cover member comprising a second region adapted to be pressurized by said pressurized fluid, throttling means interposed in the path of fluid flow between said first and second regions, whereby the fluid pressure in said second region is lower than the fluid pressure in said first region, said cover member comprising a second valve seat interposed between said second region and said second delivery means, said cover member at least partially defining said second fluid delivery means, said valve comprising a valve guiding member, and a valve member movable within said valve guiding member to alternately contact said first and second valve seats.

9. The combination of claim 8, wherein said throttling means comprise a plurality of openings in said valve guiding member interconnecting said first and second regions, and wherein the total cross-sectional area of said throttling openings are a predetermined amount smaller than the cross-sectional area of the flow means in said middle member flowing the pressurized fluid through said middle member to said first pressurized region.

10. The combination of claim 8, wherein said base member, said middle member, said valve guiding member, and said cover member, consist of powdered metal.

11. The combination of claim 8, wherein the total cross-sectional area of said throttling means is in the range of about 30% to about 75% of the cross-sectional area of said fluid flow means in said base member.

12. The combination of claim 8, wherein said cooperating defining means comprise a cross groove located between said base member and said middle member formed by facing grooves one in each of said base member and said middle member.

13. The combination of claim 8, wherein said first and second valve seats each comprise an annular land formed in one face of the respective one of said middle member and said cover member surrounded by and at least partially defined by said first and second regions, respectively, and said regions being recessed into said members from the plane of said land.

14. The combination of claim 8, wherein said middle member is formed with said first region recessed into one face thereof, said first region defining the outside of said first valve seat, said first valve seat being of annular configuration and surrounding a central through opening extending through said middle member from said one face thereof to the oppposite face thereof, and said central through opening comprising at least a part of said first delivery means.

15. The combination of claim 8, wherein said cover member is formed with said second region recessed into one face thereof, said second region defining the outside of said second valve seat, said second valve seat being of annular configuration and surrounding a central through opening extending through said cover member from said one face thereof to the opposite face thereof, and said central through opening comprising at least a part of said second delivery means.

16. An air tool including a housing, an air motor in said housing including a cylinder having a piston reciprocable therein, an air inlet in said housing connectable to an air supply, a working implement supported by said housing, an air control valve interposed between said air inlet and said cylinder to alternately provide pressurized air to opposite ends of said piston to cause said piston to reciprocate and to deliver blows to said working implement; said valve comprising a composite body having a valve member reciprocable at an opening therein, means to flow air from said air inlet to the opposite sides of said valve member, said flow means including first and second port means in said valve body communicating with first and second passage means, respectively, at opposite sides of said valve member, the cross-sectional area of said first and second passage means being greater than the cross-sectional area of said first and second port means, respectively, whereby the flow of air from each said port means to its respective passage means is substantially unrestricted, the cross-sectional area of said second port means being in the range of from about 30 to about 75% of the cross-sectional area of said first port means, whereby to throttle the air as it passes through said second port means, whereby the air pressure at said second passage means is lower than the air pressure at said first passage means, first delivery means extending from said valve opening to one end of said cylinder to deliver the air from said second passage means under the control of said valve member to one end of said piston to power said piston to its working stroke, and second delivery means extending from said valve opening to the other end of said cylinder to deliver air from said first passage means under the control of said valve member to the opposite end of said piston to return said piston.

17. An air tool including a housing, an air motor in said housing including a cylinder having a piston reciprocable therein, an air inlet in said housing connectable to an air supply, a working implement supported by said housing, an air control valve interposed between said air inlet and said cylinder to alternately provide pressurized air to opposite ends of said piston to cause said piston to reciprocate and to deliver blows to said working implement; said valve comprising a composite body having a circular valve disc member reciprocable in an opening therein, means to flow air from said air inlet to the opposite sides of said valve disc, said flow means including first and second port means in said valve body communicating with first and second passage means, respectively, at opposite sides of said valve disc, each of said passage means including an annular portion adjacent the periphery of said valve disc, the cross-sectional area of said second port means being in the range of from about 30 to about 75% of the cross-sectional area of said first port means, whereby to throttle the air as it passes through said second port means, whereby the air pressure at said second passage means is lower than the air pressure at said first passage means, first delivery means extending from said valve opening adjacent the center of said valve disc to one end of said cylnder to deliver the air from said second passage means under the control of said valve disc to one end of said piston to power said piston through its working stroke, and said second delivery means extending from said valve opening adjacent the center of said valve disc to the other end of said cylinder to deliver air from said first passage means under the control of said valve disc to the opposite end of said piston to return said piston.

* * * * *

UNITED STATES PATENT OFFICE

CERTIFICATE OF CORRECTION

Patent No. 3,935,789 Dated February 3, 1976

Inventor(s) Alva Nelson Dorsey

It is certified that error appears in the above-identified patent and that said Letters Patent are hereby corrected as shown below:

Column 2, line 65, the numeral "25" should read --25%--.

Column 2, line 68, the numeral "40" should read --40%--.

Column 3, line 47, "O ring" should read --"O" ring--.

Column 7, line 42, quotes should be placed around delivery means --"delivery means"--.

Column 12, line 58, the numeral "30" should read --30%--.

Column 14, line 3, the numeral "30" should read --30%--.

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*